US005462109A

United States Patent [19]

Vincze et al.

[11] Patent Number: 5,462,109

[45] Date of Patent: Oct. 31, 1995

[54] METHOD AND APPARATUS FOR PRODUCING METAL STRIP

[75] Inventors: Albert M. Vincze; Theodore J. Seymour, both of Oakville; Patrick Culkeen, Burlington; Nai-Yong Tang; Gerald P. Lewis, both of Mississauga; Paul Niessen, Waterloo; John V. Marlow, Oakville, all of Canada

[73] Assignee: Cominco Ltd., Vancouver, Canada

[21] Appl. No.: 956,212

[22] Filed: Oct. 5, 1992

[51] Int. Cl.[6] ..... B22D 11/06; B22D 11/10; B22D 11/12

[52] U.S. Cl. ..... 164/479; 164/417; 164/429; 164/437; 164/477; 164/489

[58] Field of Search ..... 164/479, 477, 164/429, 417, 463, 423, 489, 437

[56] References Cited

U.S. PATENT DOCUMENTS

| | | | |
|---|---|---|---|
| 4,016,925 | 4/1977 | Sumida . | |
| 4,955,429 | 9/1990 | Honeycutt, III et al. | 164/479 |
| 4,979,557 | 12/1990 | Honeycutt, III | 164/479 X |
| 5,063,990 | 11/1991 | Follstaedt et al. | 164/479 |

FOREIGN PATENT DOCUMENTS

| | | | |
|---|---|---|---|
| 934522 | 10/1973 | Canada | 164/479 |
| 2132757 | 1/1972 | Germany . | |
| 46-26626 | 8/1971 | Japan | 164/479 |
| 62-25456 | 6/1987 | Japan | 164/479 |
| 2250856 | 6/1992 | United Kingdom . | |
| WO81-00068 | 1/1981 | WIPO . | |

*Primary Examiner*—J. Reed Batten, Jr.
*Attorney, Agent, or Firm*—Arne I. Fors; Doak Horne; Jeffrey T. Imai

[57] ABSTRACT

The strip is cast on a chilled casting surface of a rotating drum from a pool of the molten metal contained in a tundish having a graphite lip insert seated therein cooperating with, the casting surface adjacent to the tundish to form and contain the pool of the molten metal. The tundish preferably contains a feed chamber, a return chamber, and a diverting chamber, the feed chamber and the diverting chamber effectively removing turbulence from the molten feed and the return chamber having a vertically adjustable weir dividing the return chamber from the diverting chamber for controlling the surface level of the pool of molten metal in the diverting chamber and the lip insert and for diverting a flow of molten metal to the return chamber. A preferred lead alloy is a low antimony-lead alloy which is cast into strip and is subjected to a heat treatment to permit expansion and shaping in subsequent production of expanded mesh battery grids. The battery grids produced by the method have improved electrochemical properties such as corrosion resistance and resistance to growth.

30 Claims, 2 Drawing Sheets

METHOD AND APPARATUS FOR PRODUCING METAL STRIP

BACKGROUND OF THE INVENTION

This invention relates to a method and apparatus for the casting of molten metals as continuous strip and, more particularly, to the casting of lead and wide-freezing range lead alloys as continous strip for use as electrode grids for batteries.

For many years, the manufacturers of lead-acid batteries have used a variety of lead alloys in the preparation of grids. The casting methods for these alloys include book mold casting, casting into a slab followed by rolling to form a wrought product in the form of a strip, belt casting, twin-belt casting, double-drum casting, and casting onto a drum rotating in a bath of molten alloy, the so-called "melt extraction solidification" or "dip-casting" method. The last-mentioned method allows the manufacture of alloy strip directly from molten alloy.

Successful dip-casting involves the providing of a smooth flow of dross-free molten metal to a zone through which the circumference of a chilled casting drum rotates. It is necessary to extract heat at a uniform rate across the width of the strip to produce a uniform thickness of the strip across the drum. The dip-casting method is suitable for casting pure lead and for casting lead alloys which possess a narrow freezing range, such as lead-calcium or lead-calcium-tin alloys. For the manufacture of battery grids from cast strip, the lead alloy strip is expanded and shaped to form the mesh used for battery grids. Other methods used for producing grids have included the direct casting of alloy in the form of a grid and the casting of grids using a rotating drum with a surface shaped to correspond with the desired grid shape.

Both the alloy compositions and the methods of casting are the subject of numerous patents. One successful process for casting lead or lead-calcium or lead-calcium-tin alloy strip using the melt extraction solidification method is disclosed in U.S. Pat. Nos. 3,926,247 and 3,858,642, while the expanding and shaping of the cast strip for the manufacture of lead-acid battery grids is disclosed in U.S. Pat. Nos. 4,291,443, 4,297,866 and 4,315,356.

Currently, many automotive battery manufacturers favour the use of low antimony-lead alloys for the positive electrodes grids in maintenance-free batteries. These manufacturers claim that the low antimony-lead alloys provide longer battery life as compared to other lead alloys such as lead-calcium alloys. Low antimony-lead alloys for positive battery plates generally contain from 0.5% to 4.0% Sb. For automotive starting batteries, the alloys usually contain from about 1.0% to no more than about 2.5% by weight of antimony. Below about 1.0% Sb, battery grids made from such alloys have reduced deep cycling capabilities. To enhance the castability, and the mechanical and electrochemical properties of the lead-antimony alloys, one or more additional alloying elements are usually added. These additional alloying elements include arsenic, copper, tin, sulfur, selenium, tellurium, silver, cadmium, bismuth, calcium, magnesium, lithium and phosphorous in amounts ranging from 0.001% to 0.5% by weight of the lead. Many of the additional alloying elements, such as sulfur, copper, selenium, tellurium and silver are added as grain refiners.

The industry, considering that one or more grain refiners are necessary to obtain battery grids with a satisfactory structure and performance, has to a large extent adopted their use. As a result, one or more of these grain refiners are now present in most of the low antimony-lead alloy compositions.

When the low antimony-lead slab cast alloys are made into battery grids by rolling to, for example, 10% of the original slab thickness, the grids made from the wrought strip product have not exhibited satisfactory life performance when used as positive electrodes due to poor corrosion resistance and undesirable grid growth, and therefore this product is not in commercial use. Currently, the positive battery grids accordingly are made by gravity casting (also known as book mold casting) methods and are relatively thick and heavy, have a porous and non-uniform microstructure which promotes corrosion, can be subject to grid growth, and cause high water loss in a battery. All these characteristics shorten the battery life. The gravity casting method, however, appears to be the only method that is used on a commercial scale to make positive low antimony grid electrodes.

It is shown in the prior art that low antimony-lead alloys for grids of maintenance-free lead-acid batteries may be cast by dip-casting on a rotating drum, by casting on a rotating drum having a grid-shaped surface, by die casting in a mould having a grid-shaped configuration of mould cavity, or by gravity casting and stamping (e.g., U.S. Pat. Nos. 3,789,909, 3,789,910, 4,455,724 and 4,456,579). The applicants herein have attempted to produce strip by dip-casting but such attempts have been unsuccessful and to date this method is not being used in industry. Similarly, the casting on a rotating drum having a grid-shaped surface has not been commercialized for positive plates because severe problems occur with the performance of batteries that contain positive plates made of low antimony lead cast by this process.

Low antimony-lead strip may be cast using the twin-roll casting method and controlling the temperature immediately after rolling in order to provide a homogeneous fine crystalline structure (U.S. Pat. No. 4,498,519). It is known that wrought antimonial lead alloys are inherently soft and that heat treatments are required to harden the alloys so that they become suitable for the manufacture of battery grids. Various heat treatment methods which include quenching or cooling, and aging steps are described in U.S. Pat. Nos. 1,674,954 to 1,674,959; 4,629,516 and 4,753,688. Also, in U.S. Pat. Nos. 4,629,516 and 4,753,688 are disclosed methods for strengthening a lead-antimony alloy by rolling the alloy, heating the alloy to provide a recrystallized structure which strengthens on aging, and quenching the alloy. The tensile strength of the treated alloys is increased. The alloys comprise 0.5% to 6% Sb and 0.002% to 1% As, the balance being lead, and 0.5% to 6% Sb, 0.002% to 1% As and 0.02% to 0.5% Sn, the balance being lead, respectively. The rolling of the alloy produces a wrought strip which is heated and subsequently quenched. Battery grids produced according to these patents, however, are also subject to the problems of corrosion and undesirable growth which shorten battery life. Negative battery plates are currently made from lead-antimony, lead calcium or lead-calcium-tin alloys by gravity casting or by expanding lead-calcium or lead-calcium-tin alloy strip.

Low antimony-lead alloys cannot be cast by dip-casting onto a smooth rotating drum for two important reasons. Firstly, the antimony in the alloy causes the molten alloy to exhibit a wide freezing range of up to 60 Celsius degrees in the preferred range of 1% to 2.5% Sb. Secondly, gravity destroys the continuity of the molten metal on the drum. As a result, a coherent, solid, thin strip of uniform thickness cannot be formed. This is especially so when the alloy contains antimony in the range from 1.0% to 1.5% Sb in which the solidification range of the alloy is at a maximum.

Another method for casting metal alloy strip is the casting onto a cooled, rotating drum from a tundish, casting trough or casting vessel positioned above or onto the side of the drum, the so-called "melt-drag" method. Although the melt-drag method of casting metal strip is used for preparing strip of aluminum, aluminum alloys, copper, copper alloys and steel, to our knowledge, the method has not been used commercially to prepare strip of wide-freezing range lead alloys, such as low antimony-lead alloys.

SUMMARY OF THE INVENTION

We have now found that lead alloys, and especially those with a wide-freezing range such as low antimony-lead alloys, can be successfully cast into strip under controlled environmental working conditions using the melt-drag method and apparatus of the present invention. The strip cast from wide-freezing range alloys may be subjected to further treatment such as heat treatment for the low antimony-lead alloy strip. We have also found that the heat-treated strip can be successfully expanded and shaped to form expanded mesh grids for use in positive electrode plates which have superior electrochemical characteristics. We have also found that strip with superior characteristics for grids can be cast from low antimony-lead alloys that do not contain conventional grain refining alloying elements. More specifically for positive plates, low antimony-lead alloys containing from about 0.5% to about 4%, preferably about 1.5% to about 3.0%, and most preferably about 1.5% to about 2.0%, antimony by weight of the lead as well as small amounts of one or more additional alloying elements, can be cast from molten alloy from a tundish onto a rotating, chilled drum by the melt-drag method. The additional alloying elements are, preferably, arsenic and tin, with no grain refiners present. Arsenic and tin are added to enhance the electrochemical and mechanical properties of the lead-antimony alloy. The amounts of arsenic and tin are, preferably, in the range of about 0.1% to 0.2% As and about 0.2% to 0.7% Sn, respectively.

The apparatus for casting strip by the melt-drag method comprises a chilled drum and a tundish. The tundish delivers to the casting surface of the drum a layer of molten metal to be dragged onto the drum surface, chilled and solidified on substantially the upper half of the drum surface. The tundish is a vessel comprising an inlet, an overflow outlet, an overflow means, a flow control means, and a casting structure. The overflow means ensures that the molten metal at the lip in the casting structure has a controlled surface level throughout the casting. The flow control ensures that the molten metal at the lip is substantially free of turbulence for improved thickness gauge control and reduced porosity.

The casting structure comprises a lip insert contoured to the shape of the drum surface. The chilled drum rotates and drags a controlled amount of molten alloy from the tundish at a substantially vertical portion of the casting surface, onto its cooled surface where the molten metal rapidly solidifies with the formation of a solid strip having predetermined dimensions. The diameter of the drum, its rotational speed, its surface finish and its surface temperature, as well as the temperature and surface level of the melt in the tundish are controlled, and so determine the casting speed and the thickness of the strip. The surface of the drum preferably is treated to provide a multitude of nucleation points for solidification of the molten metal thereon by blasting said surface with glass beads. The strip may be subjected to a treatment step following casting or following coiling. Depending on the metal alloy cast, the treatment may not be required. The treatment step such as heat treatment makes it possible to process the strip into expanded mesh for making the positive electrode battery grids without extensive breakage. The grids so produced exhibit characteristics that are superior in respect of improved corrosion resistance and reduced gas production to those exhibited by grids made according to conventional gravity casting methods.

Using the same method and apparatus, negative electrode grids can also be made from either lead-antimony, lead-calcium, or lead-calcium-tin alloys.

The melt-drag method makes it possible to continuously produce, at high-speed, positive electrodes with superior characteristics for automotive batteries from low antimony-lead alloy. The method also makes it possible to produce non-porous, thinner and lighter battery electrodes which, in turn, enable the manufacture of batteries with higher energy and power densities and improved charge and discharge performance. Extra weight in batteries entails extra cost. In that the number of electrode plates per battery is increasing because of marketing pressures to produce and sell higher cold-crank batteries, battery electrode plates should be as light as possible for particular service requirements to minimize manufacturing costs.

Accordingly, it is an important aspect of the present invention to provide a method and apparatus for the selective and controlled casting of thin strip from lead alloys having a wide-freezing range by a melt-drag method permitting improved environmental working conditions with reduced manufacturing costs. It is another aspect to provide a method for the manufacture of positive grids of low antimony-lead alloys having superior characteristics for use as grids for lead-acid batteries.

It is still another aspect to provide a continuous melt-drag method for the high-speed production of both positive and negative electrode grids having improved electrochemical properties for use in lead-acid batteries.

Thus, there is provided a method for the casting of metal strip such as lead and wide-freezing range lead alloys on a chilled casting surface comprising the steps of providing a tundish containing a pool of molten metal adjacent to said casting surface, said tundish having a floor, opposed sidewalls, a rear wall, an open front, and a baffle wall in proximity to said open front, said baffle wall having an opening for passage of the melt thereby; removably attaching in said tundish adjacent to said open front a lip insert having a floor and opposed sidewalls adapted for a fit with the tundish floor and opposed sidewalls whereby said molten metal cannot leak thereby, said lip insert having an open front defined by the lip insert floor and the lip insert sidewalls cooperating with a substantially vertical portion of the casting surface adjacent thereto to contain a pool of said molten metal in the lip insert and said lip insert having an open rear edge spaced from the tundish baffle wall for ingress of the molten metal into the lip insert; controlling the surface level of the pool of molten metal; moving said casting surface upwardly through said pool of molten metal for depositing a layer of the metal thereon, and cooling said deposited molten metal to solidify a strip of metal on the casting surface.

There is also provided an apparatus for the casting of metal strip such as lead and wide-freezing range lead alloys from a molten pool of said metal in a tundish onto a chilled casting surface adjacent thereto comprising a tundish including a floor, opposed sidewalls, a rear wall, an open front spaced from said rear wall, and a lip insert having a floor and opposed sidewalls adapted to be inserted into the tundish adjacent to the tundish open end, said lip insert having an open front defined by the lip insert floor and sidewalls for cooperation with a substantially vertical portion of the casting surface to form and to contain a pool of said molten metal in the lip insert, means for controlling the surface level of the pool of said molten melt, and means for moving the chilled casting surface upwardly through the pool of molten metal for the casting of metal on the chilled casting surface.

The tundish of the invention additionally comprises a feed chamber adjacent to the rear wall, a return chamber adjacent to the lip insert, and a diverting chamber between the feed chamber and the return chamber in communication with the feed chamber and return chamber, said feed chamber and diverting chamber cooperating for removing turbulence from the molten metal feed, and said return chamber having a vertically adjustable weir dividing the return chamber from the diverting chamber for controlling the surface level of the pool of molten melt in the lip insert and in the diverting chamber and for controlling the flow of molten metal diverted to the return chamber.

BRIEF DESCRIPTION OF THE DRAWINGS

The invention will now be described with reference to the accompanying drawings depicting the preferred embodiment of the invention, in which.

DETAILED DESCRIPTION OF THE PREFERRED EMBODIMENT

Figure 1:
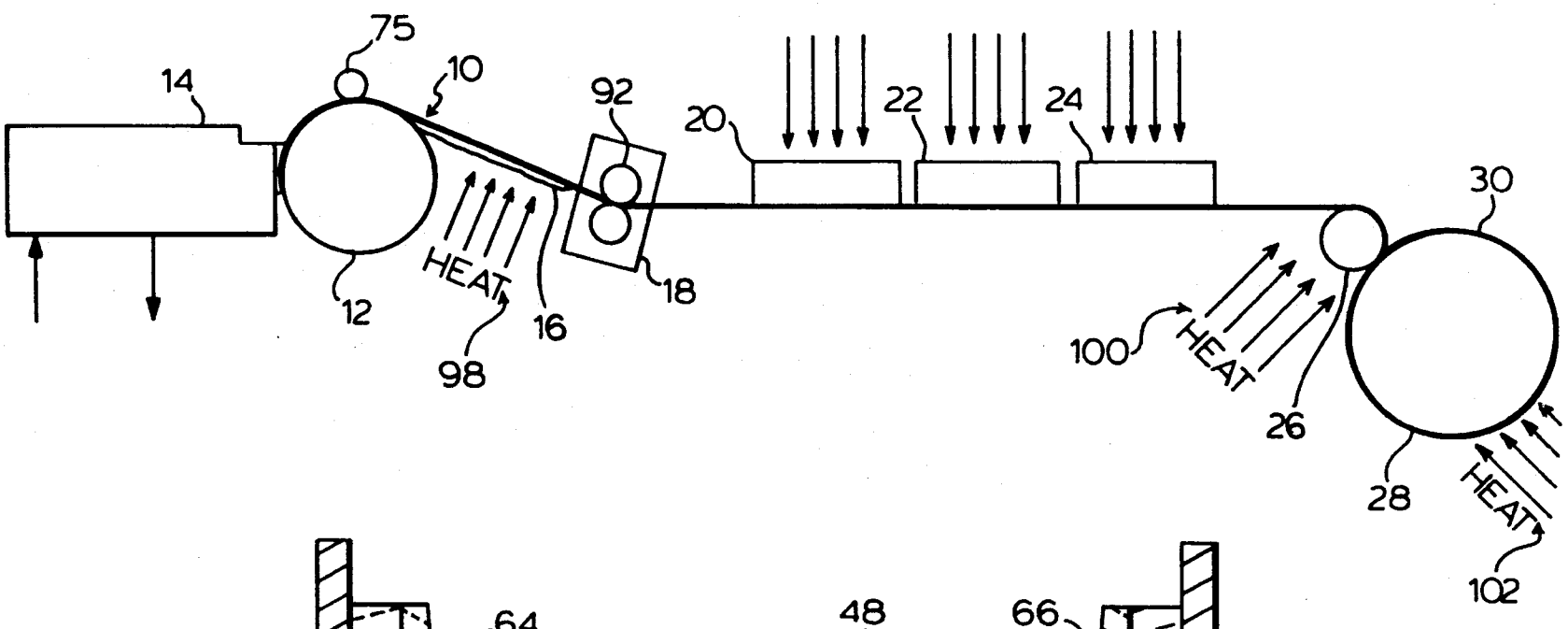
FIG. 1 is a schematic illustration of the strip casting line from the tundish to a coiler.

Strip for making grids for positive electrodes for lead-acid batteries is successfully cast in accordance with the method of the present invention, to be described, from wide-freezing range lead alloys. These alloys include low antimony-lead alloys. Although the following detailed description is with reference to low antimony-lead alloys, it will be understood that the method of the present invention is equally well suitable for the casting of strip metal such as pure lead and other lead alloys.

The low antimony-lead alloys for low-maintenance batteries may contain as little as 0.5% to no more than about 4.0% Sb by weight. This is the broadest range of antimony contents that is generally considered suitable for automotive batteries. For maintenance-free batteries, the alloys contain antimony in the range of about 1% to 3.0% Sb by weight. Below about 1% Sb in battery grids, the antimony content is too low and batteries lose the characteristics necessary for deep cycling. Above about 2% Sb in the battery grid, the batteries normally exhibit high gas evolution. However, the fine grain structure of the product of the present invention makes it possible to use antimony contents of up to about 3.0% without a marked increase in gassing. The antimony content of the alloys of the present invention is, therefore, preferably in the range of about 1% to 3.0% Sb and, more preferably, in the range of from above about 1.5% to about 2.2% Sb. The most preferred antimony contents are in the range of about 1.5% to 2% Sb by weight of the alloy, the balance lead and incidental impurities.

The low antimony-lead alloys may additionally contain one or more alloying elements such as arsenic, copper, tin, sulfur, selenium, tellurium, silver, cadmium, bismuth, calcium, magnesium, lithium or phosphorous, each present in the range of about 0.001% to 0.5% by weight. These elements may be added for a variety of reasons. Although the various low antimony-lead alloy compositions without additional alloying elements can be successfully cast using the method of the invention, it is preferred to add an amount of arsenic and an amount of tin to the low antimony-lead alloy to improve the castability and fluidity of the alloy, which increases productivity, and to improve the characteristics of the cast strip. The amount of arsenic is in the range of about 0.1% to 0.2% by weight, and the amount of tin is in the range of about 0.2% to 0.7% by weight of the alloy.

We have surprisingly found, contrary to accepted practice, that no grain-refining elements such as, for example, copper, selenium or sulfur need to be added. As will be explained in more detail, the method of the present invention causes the cast alloy strip to have an inherent fine grain structure and other superior characteristics. It is, however, understood that an alloy containing grain-refiners can be successfully cast using the method of the invention.

Lead alloys, such as lead-antimony alloys are made by using any one of a number of well-known procedures.

With reference now to the drawings, FIG. 1 shows schematically a line for casting a continuous metal strip. Lead alloy strip 10 produced by drum 12 in combination with tundish 14 travels across heated take-off plate 16 to slitter 18 for trimming the side edges of the strip 10 and then passes under gas heaters 20, 22 and 24 arranged in sequence to a lay-on roll 26 for additional heating prior to winding on mandrel 28 to form coil 30.

Figure 3:
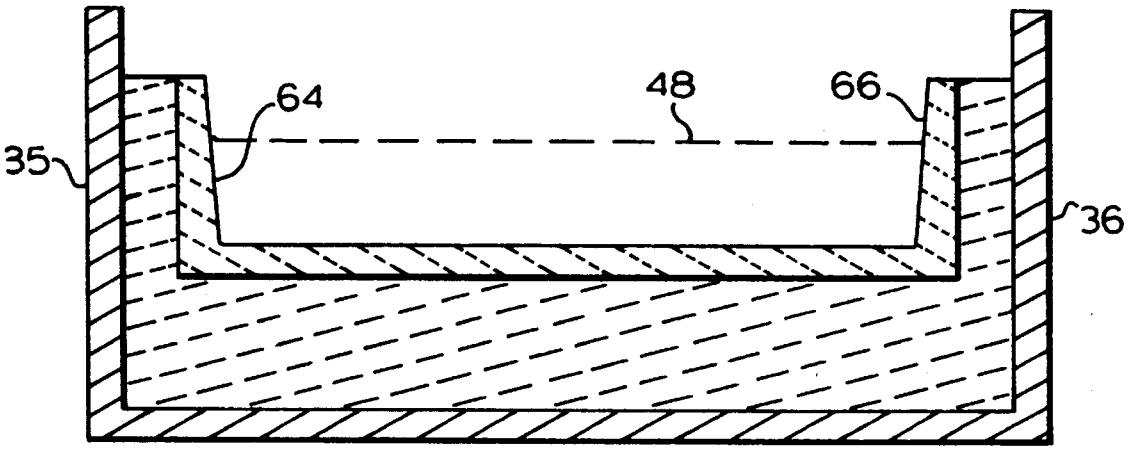
FIG. 3 is a transverse sectional view of the casting structure shown in FIG. 2.
Figure 2:
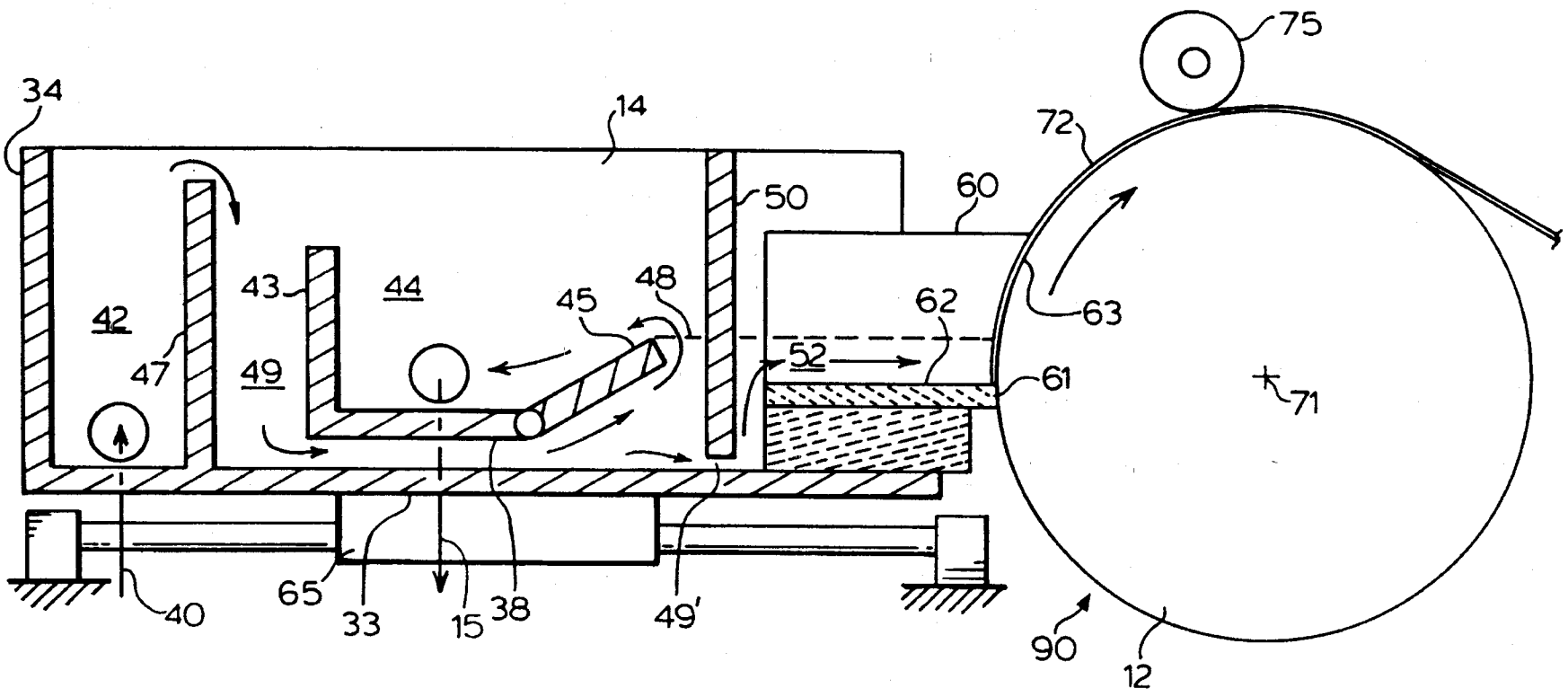
FIG. 2 is a longitudinal sectional side view of the tundish and the casting drum.

FIGS. 2 and 3 show in detail the casting drum 12 and tundish 14. The tundish 14 is defined by a horizontal bottom 33, an endwall 34, and two parallel sidewalls 35 and 36. The tundish has an inlet, up-spout 40 for the introduction of molten lead alloy to feed chamber 42 defined by endwall 34 and turbulence plate 47. Molten lead alloy passes over a weir defined by the top of turbulence plate 47 into diverting chamber 49. A portion of the molten lead alloy is diverted to return chamber 44 which is defined by wall 43, floor 38, and adjustable weir 45. Adjustable weir 45, hingely attached to return chamber floor 38, controls the surface height of molten lead alloy, as depicted by numeral 48. Gap 49 defined between floor 38 and the lower edge of vertical baffle 50 allows molten lead alloy to flow into casting chamber 52 to a height equal to height 48 in chamber 49. Lip insert structure 60, secured to tundish 14, has a base floor 62 and parallel sidewalls 64, 66 to define the floor and sides of casting chamber 52. The rear of chamber 52 is defined by vertical baffle 50 and the front thereof is defined by drum 12. Lip insert 60 preferably is machined from graphite.

With reference now to FIG. 3, lip insert structure 60, removably attached to the tundish, has sidewalls 64, 66 with opposed interior surfaces preferably sloping upwardly and outwardly away from the melt. These sloping sidewalls give relief to the solidifying edges of the metal alloy being cast to a strip.

With reference again to FIG. 2, the casting drum 12 is rotatable around a horizontal axis 71. The outer circumferential surface 72 of drum 12 is substantially smooth and is, preferably, conditioned by treating with a medium such as by blasting with glass beads to provide nucleation points for the solidification of the molten alloys. The rotatable drum is also furnished with edge rolls 75, one of which is shown, which ensure that the edges of the metal strip 10 are completely solidified prior to the removal of the strip 10 from the drum surface 72. The edge rolls 75 press the outer edge on each side of the strip firmly onto the drum surface 72 to provide the necessary cooling of the metal strip and subsequently to produce the required integral edges of the continuous cast metal strip 10. Drum 12 is internally cooled with water, using well-known circulating means (not shown). The diameter of the drum 12, its rotational speed, the finish texture and the temperature of the outer surface 72 of the drum, and the temperature and the surface level 48 of the melt in the tundish, determine the amount of melt which is dragged onto the outer surface 72 on substantially the upper half of the drum from the bath of molten metal in the tundish, thereby determining the thickness of the strip. The cooled drum surface 72 causes the freezing solidification of the molten metal into a strip 10 of substantially constant width and thickness.

The molten metal alloy flows from a holding vessel (not shown) via a molten-metal centrifugal pump (not shown) through the up-spout 40 into the feed chamber 42 and over the weir defined by turbulence plate 47 into the diverting chamber 49. At the end of the diverting chamber 49, the metal flow is diverted into the two flows; one upwardly over the adjustable weir 45 into the return chamber 44, and the other through control gap 49'. The molten metal alloy flowing over the adjustable overflow weir 45 flows into return chamber 44 and then into a holding vessel for molten alloy by way of downspout 15. The surface level 48 is controlled by the adjustable overflow weir 45 to ensure the proper surface level of the molten metal in chamber 52 at drum 12. The molten metal is pumped into tundish inlet chamber 42 at a rate to ensure that the molten metal is always in excess and continually flows over the weir 45 into return chamber 44. Any slag that may be formed or is contained in the molten metal separates easily from the melt in the tundish between turbulence plate 47 and return chamber wall 43. The adjustable weir 45, the flow control baffle 50 and the control gap 49' effectively control the amount, the surface level 48 and, in combination with turbulence plate 47, the turbulence of the molten metal in the tundish. A substantially quiescent flow of molten metal with a substantially constant depth (thickness) is now presentable to the rotatable drum 12.

In presenting the molten metal to the drum surface 72, the lip insert structure 60 and the drum-abutting surface 61 thereof must be of the proper design and in the proper position. The lip insert structure 60 design must ensure that there are no obstructions that could cause the solidifying metal to bind to the lip insert during casting. The sides 64, 66 of the lip insert 60 thus are sloped upwardly and outwardly away from the molten metal. The surface 63 of the lip structure 60 abutting drum 12 must be contoured to match the exact curvature of the drum surface 72. The position of the lip surface 63 is positioned in close proximity to the drum surface 72 at about the "nine to ten o'clock" position. The surface 63 does not touch the drum surface 72 as the molten metal is transferred from the lip structure 60 to the drum surface 72. However, too much space between the surface 63 and the drum surface 72 results in a spillout of the molten metal and termination of the cast. Adjusting mean 65, such as high precision guide rod-ball bearing assembly, a rack-and-pinion or a dove-tail slide, is provided to rapidly and accurately move tundish 14 and lip insert 60 towards and away from drum 12 and its surface 72 to obtain proper positioning and correct space therebetween.

A lip insert 60 made of graphite is particularly well-suited for this purpose in that the graphite is softer than the metal of drum surface 72 and surface 63 can readily be formed for close conformity with drum surface 72 by wrapping sand paper about drum surface 72 and abutting surface 63 against drum surface 72 while the casting drum is rotated. In addition, graphite is well-suited in that it is not easily wetted by the molten metal.

As the rotatable drum 12 is rotated, a predetermined amount of molten alloy is dragged onto its casting surface 72. The metal alloy solidifies to form strip 10 which usually leaves the drum at about the "twelve to two o'clock" position and finished strip 10 is pulled from the rotating drum 12 by two parallel rubber coated pull rollers 92, one of which is shown in FIG. 1, which may form part of slitting assembly 18. The rollers 92 are driven by an adjustable speed motor (not shown) which is adjusted to the rotation of drum 12 to achieve and preferably continuously maintain a desired pulling tension on the strip as it is stripped from the casting surface.

Prior to passing over lay-on roll 26, the strip is passed between adjustable rotary knives in slitter 18 that trim the outside edges of the strip to provide strip with a precise, desired width. The strip may be passed over an eddy current gauge, not shown, which continuously monitors the thickness of the strip across its width. A digital read-out is provided which provides the information necessary to ensure that the strip has and can be maintained at the desired thickness. The strip is then passed to a torque-controlled wind-up mandrel 28 for coiling.

The coiled strip in the case of low antimony-lead strip cannot be used directly for the manufacture of battery grids, since the coiled strip does not have sufficient resistance to fracture in the downstream slitting and expanding operations. To increase its resistance to fracture in the slitting and expanding operations, the strip, immediately after casting and during coiling as a continuous casting-heat treatment operation, or by a subsequent batch treatment of coils, is subjected to heat treatment. The low antimony-lead alloy strip is heated to a temperature above about 190° C., preferably to a temperature in the range of about 200° C. to 230° C., and maintained at the elevated temperature for at least about 10 minutes to homogenize the antimony as a fine dispersion in the lead matrix, thereby acquiring expandability with good integrity and strength. The heat treatment of the low antimony lead enables the successful production of expanded mesh battery grids with superior electrochemical characteristics without breakage.

The invention will now be illustrated by the following non-limitative example.

EXAMPLE

A typical low antimony-lead alloy having a composition comprised by weight of 1.8% Sb, 0.15% As, 0.16–0.2% Sn, and the balance lead, was heated to about 400° C. in the tundish 14 of the invention and cast at a speed of 36–38 feet/minute with a gauge of 0.217 inch cast and strip width of 3.604 inch on a drum surface which had been prepared by blasting with glass beads. The strip temperature on the drum 12 at top centre was 140° C. , the drum periphery being cooled by water circulating through the drum at a temperature between 100°–110° F. The strip travelled across a 24 inch long heated take-off plate heated to 190° C. in the centre of the plate by four 13 inch 125 watt strip heaters 98 to provide a strip temperature of about 170° C.

The strip was then passed through slitter 18 under tension of draw rollers 92 for trimming of the strip edges and passed 10 feet under heaters 20, 22 and 24 each 4 inches wide and 36 inches long to lay-on roll 26. The heaters 20, 24 and 24 were each fitted with 4 inch metal sides and a top to partially enclose the strip passing therethrough. It is desired to heat the strip to at least 190° C. and maintain the strip at that temperature for at least 10 minutes to acquire expandability with good integrity and strength. Heater 20 preferably provides the highest temperature with heaters 22 and 24 providing somewhat lower temperatures to heat strip 10 to a target temperature of about 200° C. Supplementary heat, such as by an acetylene torch 100, preferably indirectly heats the strip to above 200° C. by applying heat to lay-on roll 26. Heat is applied to the coil at 102 by a spreader flame fuelled by propane to retard cooling of the coil.

The strip can be heated continuously during production as shown in FIG. 1 and maintained at an elevated temperature of at least 190° C. in the coil 30 for at least 10 minutes before being slowly cooled. Alternatively, the produced strip can be directly wound on a mandrel to form a coil without heating, and permitted to cool. The coil can be subjected to a desired heat treatment by the manufacturer of the battery grids at a later date.

The present invention provides a number of important advantages. The strip produced by the method of the invention is substantially free of porosity, has smooth surfaces, and has a predetermined and precise width and a predetermined, substantially even and constant thickness. The thickness of the strip is such that grids made from the strip may be thinner than conventional battery grids made according to prior art processes. The thickness of strip may be in the range of about 0.5 to 1.0 mm which is about 50% of the thickness of prior art grids. The thinner grids enable the battery manufacturer to make batteries that have a higher energy and power densities. The grids are resistant to corrosion and to creep during use and have been found to be superior to wrought grids of the same composition produced by slab casting and roll working.

It will be understood that temperatures and duration of heating may vary according to the alloy composition and according to the heat treatment desired.

It will also be understood that modifications can be made in the embodiment of the invention illustrated and described herein without departing from the scope and purview of the invention as defined by the appended claims.

We claim:

1. A method for the casting of metal strip on a moving, chilled casting surface on substantially the upper half of a rotatable casting drum from a pool of molten metal comprising:

providing a tundish containing a pool of molten metal adjacent a substantially vertical portion of said casting surface, said tundish having a feed chamber, a return chamber and a diverting chamber and having an open front in proximity to the casting surface, removably attaching in said tundish adjacent said open front a graphite lip insert having a floor and opposed sidewalls adapted for a fit with the tundish open front whereby said molten metal cannot leak thereby, said graphite lip insert having an open front defined by the lip insert floor and the lip insert sidewalls cooperating with the substantially vertical portion of the casting surface adjacent thereto to contain the pool of said molten metal in the lip insert;

controlling the surface level of the pool of molten metal;

moving said casting surface upwardly through said pool of the molten metal by rotating said drum for depositing a layer of the molten metal thereon;

cooling said molten metal to solidify a strip of the metal on the casting surface; and stripping the metal strip from the casting surface.

2. A method as claimed in claim 1, in which the metal is a lead or wide-freezing range lead alloy.

3. A method as claimed in claim 2, in which the wide-freezing range alloy is a low antimony lead alloy containing about 0.5 to about 4.0% by weight antimony, the balance lead, and heat treating the cast metal strip by heating the said strip to a temperature of at least 190° C. for a time sufficient whereby the cast strip acquires expandability with good integrity and strength.

4. A method as claimed in claim 3 in which the low antimony lead alloy contains about 1.5% to about 3.0% antimony and the cast strip is heated to a temperature of at least 190° C. for at least 10 minutes.

5. A method for the casting of metal strip on a moving, chilled casting surface on substantially the upper half of a rotatable casting drum from a melt of said metal comprising:

providing a tundish containing a metal melt adjacent a substantially vertical portion of said casting surface, said tundish having a floor, opposed sidewalls, a rear wall, an open front, and a baffle wall in proximity to said open front, said baffle wall having an opening for passage of the melt thereby; removably attaching in said tundish adjacent said open front a lip insert having a floor and opposed sidewalls adapted for a fit with the tundish floor and opposed sidewalls whereby said melt cannot leak thereby, said lip insert having an open rear edge spaced from the tundish baffle wall and opening for ingress of the melt therebetween and said lip insert having an open front defined by the lip insert floor and the lip insert sidewalls cooperating with substantially vertical portion of the casting surface adjacent thereto to contain a pool of said melt in the lip insert; controlling the surface level of the melt pool; moving said casting surface upwardly through said pool of the melt by rotating said drum for depositing a layer of the melt thereon; cooling said melt to solidify a strip of metal on the casting surface; and stripping the metal strip from the cast surface.

6. A method as claimed in claim 5, further comprising providing a turbulence plate between the rear wall and the baffle wall to define a tundish feed chamber, and introducing melt into the feed chamber for passage over the turbulence plate.

7. A method as claimed in claim 6, further comprising providing a return chamber and a vertically adjustable weir between the turbulence plate and the baffle wall for controlling the surface level of the melt pool and the flow of melt to the return chamber.

8. A method as claimed in claim 7, further comprising providing a diverting chamber between the feed chamber and return chamber for diverting a portion of the melt to the melt pool in the lip insert and diverting a portion of the melt over the weir into the return chamber.

9. A method as claimed in claim 8, further comprising providing a pair of spaced apart edge rolls in rolling abutment with the casting surface for pressing the solidified strip against the casting surface.

10. A method as claimed in claim 9, further comprising heating the cast strip for heat treatment of the cast strip, and winding said heated cast strip onto a mandrel.

11. A method as claimed in claim 8, further comprising controlling the thickness of the cast strip by varying the surface level of the melt pool and by varying the speed of moving the casting surface upwardly through the pool of the molten metal melt.

12. A method as claimed in claim 11, further comprising treating the casting surface to provide a multitude of nucleation points for solidification of molten alloy thereon by blasting said surface with glass beads.

13. A method as claimed in claim 5, in which said metal is lead or a wide-freezing range lead alloy.

14. A method as claimed in claim 13, in which the lead alloy is a wide-freezing range alloy comprised of low antimony-lead alloy containing about 0.5% to about 4% by weight antimony, the balance lead.

15. A method as claimed in claim 13, further comprising in which the lead alloy is a wide-freezing range alloy comprised of low antimony-lead alloy containing about 1.5% to about 3.0% by weight antimony, the balance lead.

16. A method as claimed in claim 13, in which the lead alloy is a wide-freezing range alloy comprised of low antimony-lead alloy containing about 1.5% to about 2.0% by weight antimony, the balance lead.

17. A method as claimed in claim 15, in which the low antimony-lead alloy is cast onto the casting surface at a temperature of about 400° C. and the cast strip is subjected to a heat treatment comprising heating the said strip to a temperature of at least 190° C. and maintaining the heated cast strip at at least 190° C. for at least 10 minutes whereby the cast strip acquires expandability with good integrity and strength.

18. A method as claimed in claim 15, in which the low antimony-lead alloy additionally contains by weight about 0.1% to about 0.2% arsenic and about 0.2% to about 0.7% tin.

19. A method as claimed in claim 5, in which the metal is a wide freezing range lead-calcium alloy.

20. A method for the casting of metal strip on a moving, chilled casting surface on substantially the upper half of a rotatable casting drum from a pool of molten metal comprising:

providing a tundish containing a pool of molten metal adjacent a substantially vertical portion of said casting surface, said tundish having a feed chamber, a return chamber and a diverting chamber and having an open front in proximity to the casting surface, providing a baffle wall between the diverting chamber and the open front for baffling a flow of molten metal from the diverting chamber to the open front, removably attaching in said tundish adjacent said open front a graphite lip insert having a floor and opposed sidewalls adapted for a fit with the tundish open front whereby said molten metal cannot leak thereby, said graphite lip insert having an open front defined by the lip insert floor and the lip insert sidewalls cooperating with the substantially vertical portion of the casting surface adjacent thereto to contain the pool of said molten metal in the lip insert; maintaining the flow of molten metal from the diverting chamber to the pool of metal in the lip insert whereby molten metal in the diverting chamber and the pool of metal in the lip insert have the same surface level; controlling the surface level of the pool of molten metal in the lip insert by adjusting the level of molten metal in the diverting chamber; moving said casting surface upwardly through said pool of the molten metal by rotating said drum for depositing a layer of the molten metal thereon; cooling said molten metal to solidify a strip of the metal on the casting surface; stripping the metal strip from the casting surface; and heat treating the cast metal strip by heating the said strip to a temperature of at least 190° C. for at least 10 minutes whereby the cast strip acquires expandability with good integrity and strength.

21. An apparatus for direct casting of strip from a pool of molten metal in a tundish onto a chilled casting surface adjacent thereto on substantially the upper half of a rotatable casting drum comprising a tundish including a feed chamber, a return chamber and a diverting chamber having passageways communication said chambers in sequence, said tundish having an open front in proximity to a substantially vertical portion of the casting surface, a lip insert having a floor and opposed sidewalls adapted to be inserted into the tundish adjacent the tundish open front, said lip insert having an open front defined by the lip insert floor and sidewalls for cooperation with the casting surface to contain a pool of said molten metal having a surface level within the lip insert, said pool being in pressure communication with the diverting chamber whereby the surface level of the pool in the lip insert is the same as a surface level of molten metal in the diverting chamber, means for controlling the surface level of the pool of said molten metal in the diverting chamber to control the surface level in the lip insert, and means for moving the chilled casting surface upwardly through the pool of molten metal for the casting of metal on the chilled casting surface.

22. An apparatus as claimed in claim 21, in which said means for controlling the surface level of the molten pool of metal in the diverting chamber is a vertically adjustable weir separating the diverting chamber from the return chamber.

23. An apparatus as claimed in claim 22 in which said lip insert is graphite.

24. An apparatus for direct casting of strip from a pool of molten metal in a tundish onto a chilled casting surface on substantially the upper half of a rotatable casting drum adjacent thereto comprising a tundish including a floor, opposed sidewalls, rear wall, an open front spaced from said rear wall, a baffle wall in proximity to said open front having an opening for passage of molten metal thereby, and a lip insert having a floor and opposed sidewalls adapted to be inserted into the tundish adjacent the tundish open end, said lip insert having an open rear edge spaced from the tundish baffle wall for ingress of molten metal, and an open front defined by the lip insert floor and sidewalls for cooperation with a substantially vertical portion of the casting surface to contain a pool of said molten metal within the lip insert, means for controlling the surface level of the pool of said molten metal, and means for moving the chilled casting surface upwardly through the pool of molten metal for casting of metal on the chilled casting surface.

25. An apparatus as claimed in claim 24, in which said tundish additionally comprises a feed chamber adjacent the rear wall, a return chamber adjacent the baffle wall, and a diverting chamber between the feed chamber and the return chamber in communication with the feed chamber and return chamber, said feed chamber having a turbulence plate dividing the feed chamber from the diverting chamber and said diverting chamber having a vertically adjustable weir separating the return chamber from the diverting chamber for controlling the surface level of the pool of molten metal in the diverting chamber and the lip insert and for diverting the flow of molten metal to the return chamber.

26. An apparatus as claimed in claim 25, in which said baffle wall has a lower edge spaced from the tundish floor for defining an opening for passage of molten metal from the diverting chamber to the lip insert.

27. An apparatus as claimed in claim 26, in which said lip insert is machined from graphite and in which the lip insert floor and opposed sidewalls are contoured with the casting surface.

28. An apparatus as claimed in claim 27, in which the chilled casting surface is the surface of a cylindrical drum having a longitudinal axis about which the casting surface rotates, said cylindrical drum having cooling passages for the flow of cooling water therethrough.

29. An apparatus as claimed in claim 28, in which a pair of spaced apart edge rolls are rotatably mounted to abut the casting surface and to press the cast strip against the casting surface.

30. An apparatus as claimed in claim 29, in which draw rollers are mounted for rotation for receiving metal strip from the drum and for drawing the metal strip from the drum under tension.

* * * * *